US008209775B2

(12) United States Patent
Makis

(10) Patent No.: US 8,209,775 B2
(45) Date of Patent: Jul. 3, 2012

(54) CONVERTIBLE GAMING GLOVE

(76) Inventor: Denis P. Makis, Tampa, FL (US)

( * ) Notice: Subject to any disclaimer, the term of this patent is extended or adjusted under 35 U.S.C. 154(b) by 292 days.

(21) Appl. No.: 12/483,756

(22) Filed: Jun. 12, 2009

(65) Prior Publication Data

US 2010/0313332 A1 Dec. 16, 2010

(51) Int. Cl.
*A41D 19/00* (2006.01)

(52) U.S. Cl. ..... 2/162; 2/163; 2/161.1; 2/159; 2/161.6

(58) Field of Classification Search ..... 2/162, 163, 2/161.1, 161.2, 161.3, 161.5, 161.6, 161.8, 2/159, 160, 161.7; 473/59, 60, 61, 43, 205; 294/25, 26; 602/21
See application file for complete search history.

(56) References Cited

U.S. PATENT DOCUMENTS

| | | | | | |
|---|---|---|---|---|---|
| 849,182 | A | * | 4/1907 | Adkins | 2/161.6 |
| 883,761 | A | * | 4/1908 | Taylor et al. | 294/25 |
| 1,358,823 | A | * | 11/1920 | Burden | 2/163 |
| 1,358,824 | A | * | 11/1920 | Burden | 2/163 |
| 2,740,968 | A | * | 4/1956 | Gardocki | 2/161.5 |
| 4,881,275 | A | * | 11/1989 | Cazares et al. | 2/161.1 |

* cited by examiner

*Primary Examiner* — Alissa Tompkins
(74) *Attorney, Agent, or Firm* — GrayRobinson, P.A.; Michael J. Colitz, III

(57) ABSTRACT

Disclosed is a convertible gaming glove. The glove includes both fixed and removable parts. More specifically, the glove includes fix portions for covering the wrist, dorsal side of the hand, and upper portion of the palm. The glove also includes removable portions for covering the finger tips and palm. Thus, the glove can be configured to optimize tactile feel, grip and moisture absorption.

4 Claims, 11 Drawing Sheets

CONVERTIBLE GAMING GLOVE

BACKGROUND OF THE INVENTION

1. Field of the Invention

This invention relates to a convertible glove. More specifically, the invention relates to a gaming glove with removable finger tip and palm covers.

2. Description of the Background Art

Gloves are used by athletes in a wide variety of sports. For example, gloves are worn by baseball players to ensure a tight hold on baseball bats, by golfers to prevent calluses from repeatedly gripping golf clubs, and by cyclists to absorb sweat when holding on to handlebars. In each instance, the glove must cover a sufficient amount of the hand to provide adequate protection, grip, and moisture absorption. But these objectives must be achieved without covering so much of the hand that the user loses the sense of touch and feel that are often critical in sporting endeavors.

Sporting gloves of the prior art typically employ a fixed and unitary construction with a single piece of material that completely envelops the palm, dorsal side, and digits of the hand. Such gloves afford maximum protection and grip but sacrifice touch and feel. Alternatively, some gloves offer more touch and feel by only covering limited portions of the hand. For example, some cycling gloves cover the palm and dorsal side of the handle while leaving the fingers exposed. Although such gloves vastly improve touch and feel, the wearer is not afforded the option of protecting the finger tips when needed.

The present discussion has thus far contemplated the gloves for such sports as baseball, golf and cycling. However, in recent years, competitive video gaming has risen in prominence and popularity. In fact, there are now numerous video game leagues and tournaments that offer cash prizes to participants. Like athletes in more traditional sports, video gamers in these competitive situations need to ensure a proper grip upon the input device, which is often a joystick, steering wheel or other controller. As such, gamers often turn to baseball or golf gloves in order to achieve a proper grip. Yet, these gloves do not provide any touch and feel to the underlying controller.

SUMMARY OF THE INVENTION

It is therefore one of the objectives of this invention to provide a gaming glove that gives its user an adequate grip without unduly sacrificing touch and feel.

It is another object of this invention to provide a glove that can be worn by gamers while playing video games.

Yet another object of this invention is to provide a convertible glove that can selectively cover or expose portions of the user's hand.

It is another object of the present invention to provide a gaming glove with removable digits.

It is yet another object of the present invention to provide a gaming glove with a removable palm piece.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 2:
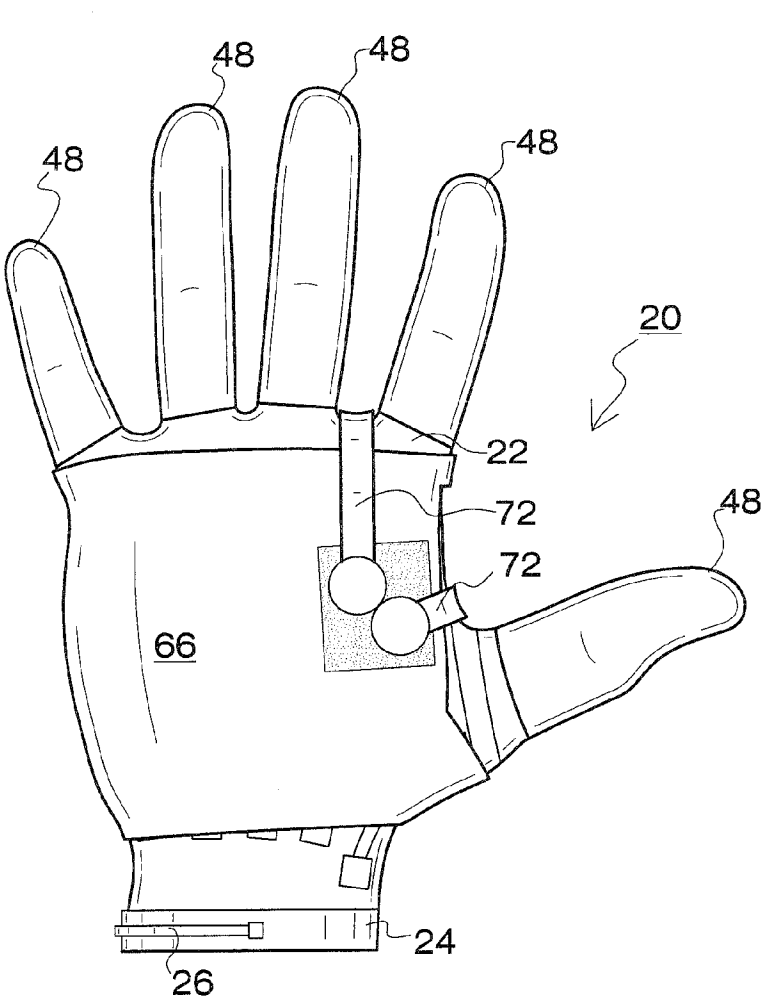
FIG. 2 is a top plan view of the glove with the removable cover covering the dorsal side of the hand.
Figure 1:
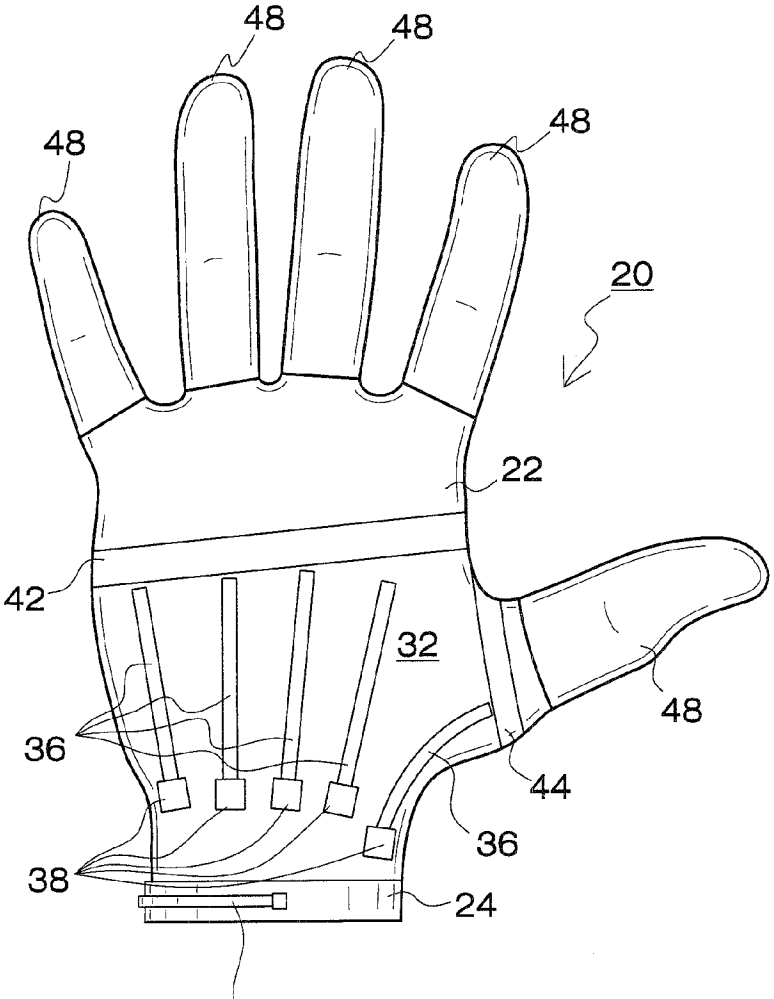
FIG. 1 is a top plan view of the glove with finger tip covers.
Figure 3:
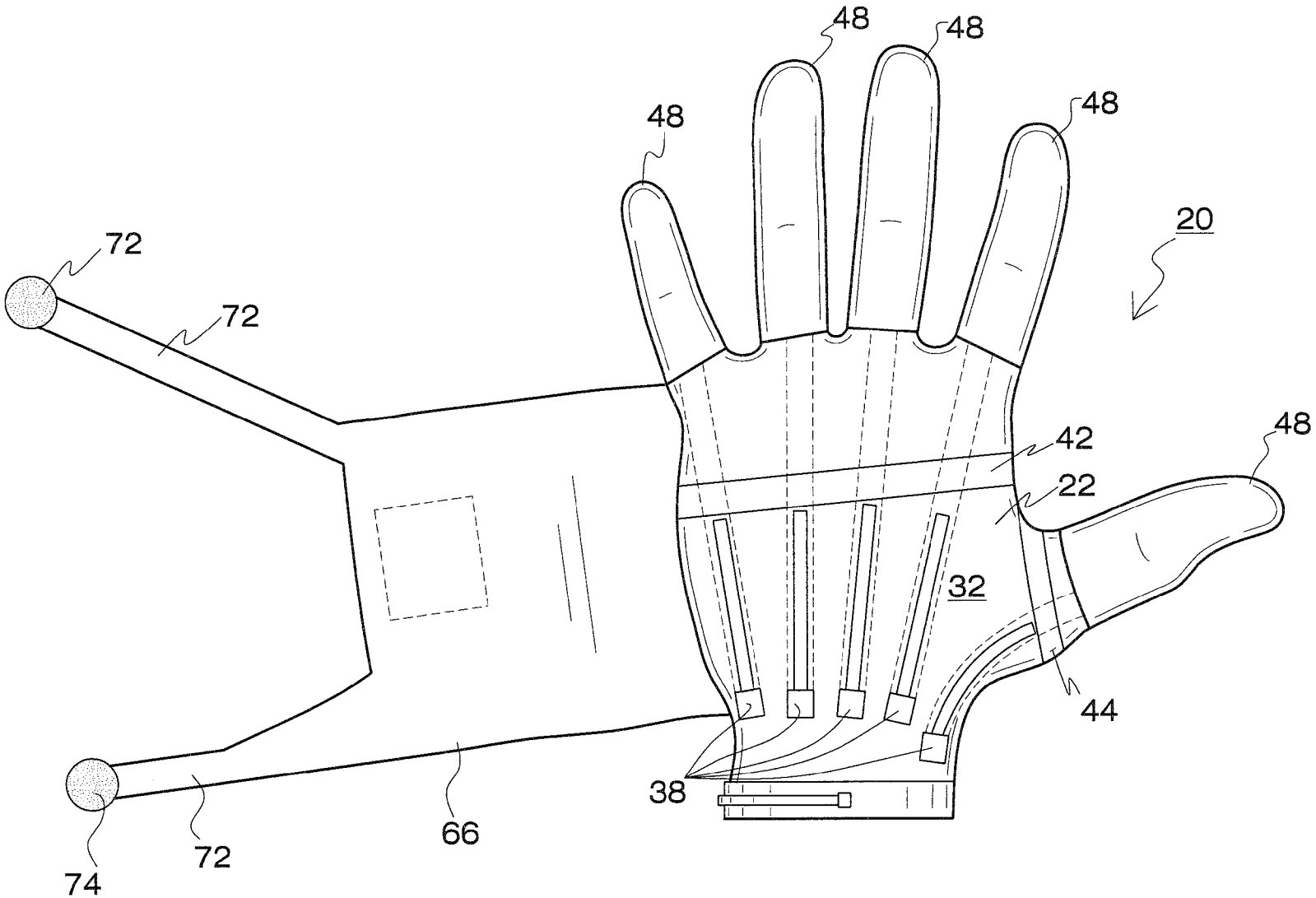
FIG. 3 is a top plan view of the glove showing the removable cover positioned to the side of the hand.
Figure 5:
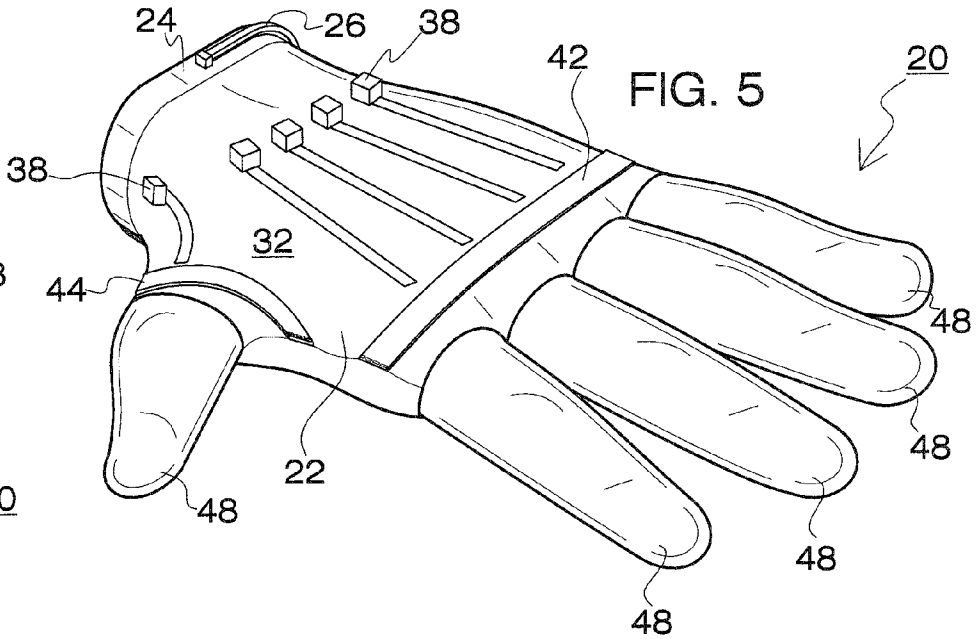
FIG. 5 is a perspective view of the glove of the present invention.

The present invention relates to a convertible gaming glove. The glove can be worn, for instance, when playing a video game. The glove includes both fixed and removable parts. More specifically, the glove includes fix portions for covering the wrist, dorsal side of the hand, and upper portion of the palm. The glove also includes removable portions for covering the finger tips and palm. Thus, the glove can be configured to optimize tactile feel, grip and moisture absorption. The various details of the present invention, and the manner in which they interrelate, will be described in greater detail hereinafter.

The primary component of glove 20 is body 22. Body 22 includes a fixed wrist portion 24 that encircles the user's wrist. An additional securing means, such as an adjustable Velcro™ strap can also be included at the base of the glove. Wrist portion 24 includes a first track 26 that, in the preferred embodiment, spans an 180° arc around the periphery of the user's wrist. Track 26 is formed from a hardened plastic and is adapted to interfit with a cooperating track element as described hereinafter.

Body 22 further includes a fixed web portion 28 that covers the upper portion of the user's palm. As most clearly illustrated in FIGS. 11 and 12, web portion 28 is a narrow band of material that covers the base of the fingers on the palm side of the hand. Body 22 also includes a fixed panel portion 32 that covers the back, or dorsal side, of the hand. In the preferred embodiment, panel portion 32 is substantially larger than web portion 28. Wrist portion 24, web portion 28 and panel portion 32 are preferably formed from a single piece of material.

Figure 6:
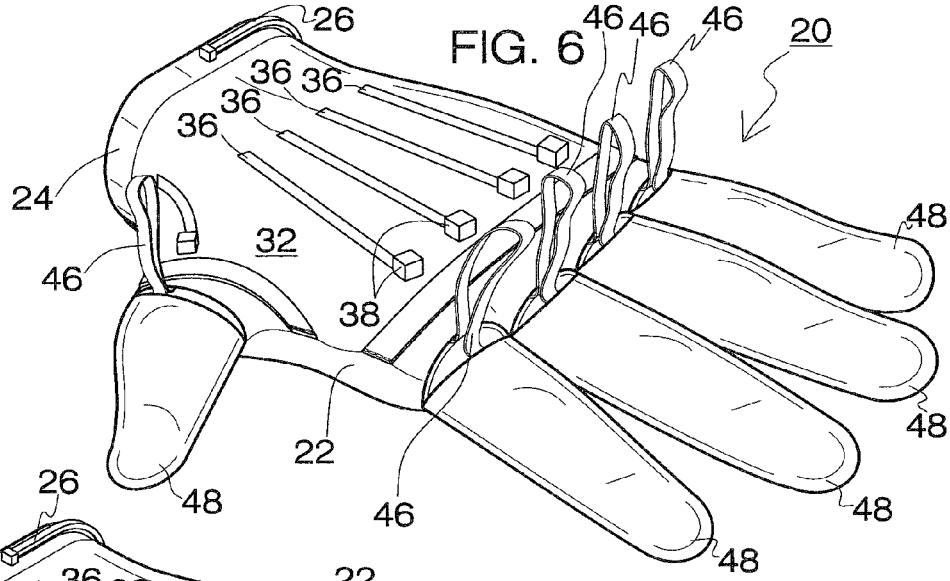
FIG. 6 is a perspective view of the glove with the finger tips in the non-extended position and with slack in the associated finger bands.
Figure 7:
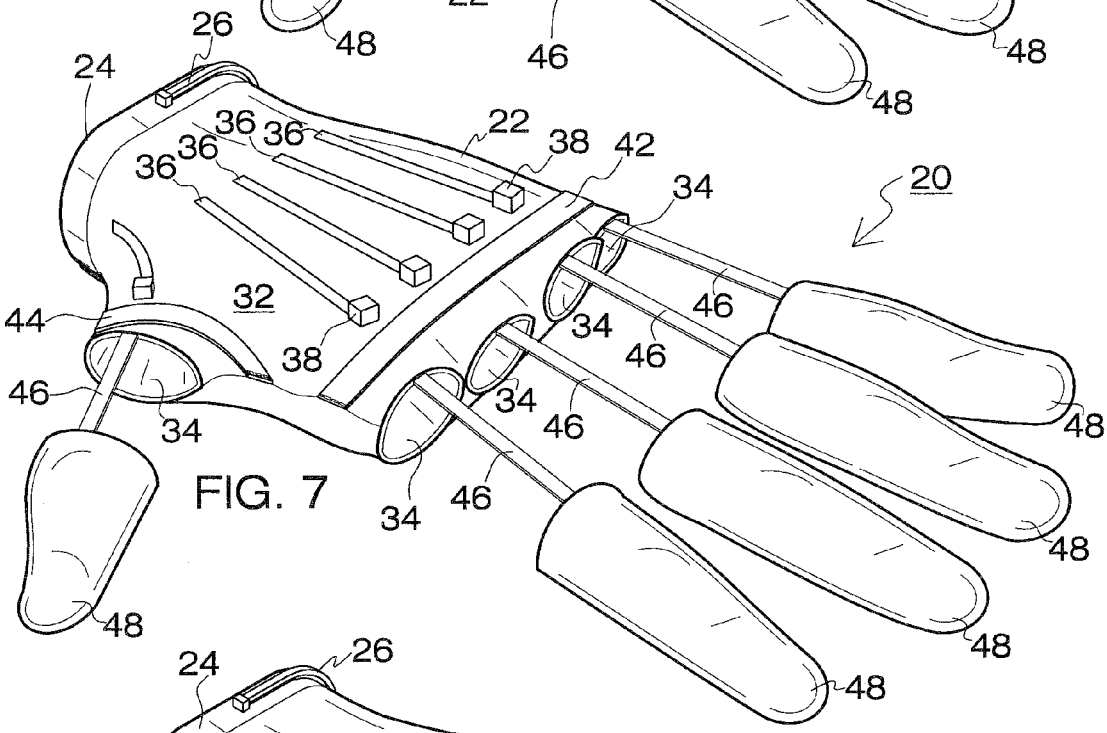
FIG. 7 is a perspective view of the glove with the finger tips in the extended positions and with the slack removed from the associated finger bands.
Figure 8:
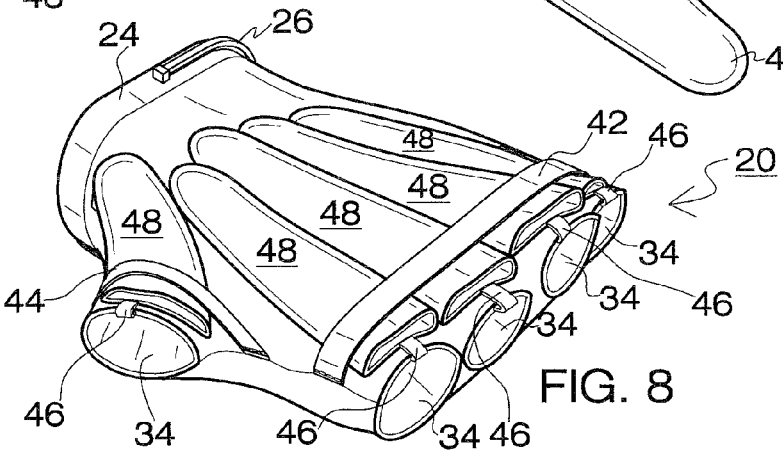
FIG. 8 is a perspective view of the glove with the finger tip covers folded back upon the dorsal side of the glove.

As illustrated in FIGS. 6-8, glove body 22 has five finger openings 34 for the user's fingers. Namely, openings 34 are included for the pinky, ring, middle and index fingers in addition to a thumb opening. A channel 36 is associated with each of the finger openings 34 and is formed within panel portion 32 of body 22. A knob 38 is secured within each of the channels 36 and can be selectively positioned anywhere along its length. The function of the channels 36 is described in greater detail hereinafter.

With continuing reference to FIGS. 6-8, a pair of retaining bands are secured upon the panel portion. More specifically, a first retaining band 42 is positioned below the openings 34 for the pinky, ring, middle and index fingers, and a second retaining band 44 is positioned below the thumb opening 34. These bands (42, 44) can be formed from a resilient material with opposing ends that are stitched or otherwise secured to the panel portion 32 of glove 20.

Convertible glove 20 also includes a series of finger bands 46, one for each of the user's fingers. Each of the bands 46 is associated with a corresponding finger opening 34 and channel 36. Bands 46 are defined by proximal and distal ends, with the proximal end being closest to the base of the hand and the distal end being closest to the finger tips. The proximal end of each band 46 is secured to an associated knob 38. Thus, bands 46 are moved via the associated knob 38. Moreover, the length of the finger bands 46 is such that an individual band is fully retracted when the associated knob 38 is in the proximal position and fully extended when the associated knob 38 is in the distal position. As illustrated, these bands function in releasably securing the finger tip covers 48 upon the fingers of a user.

Figure 4:
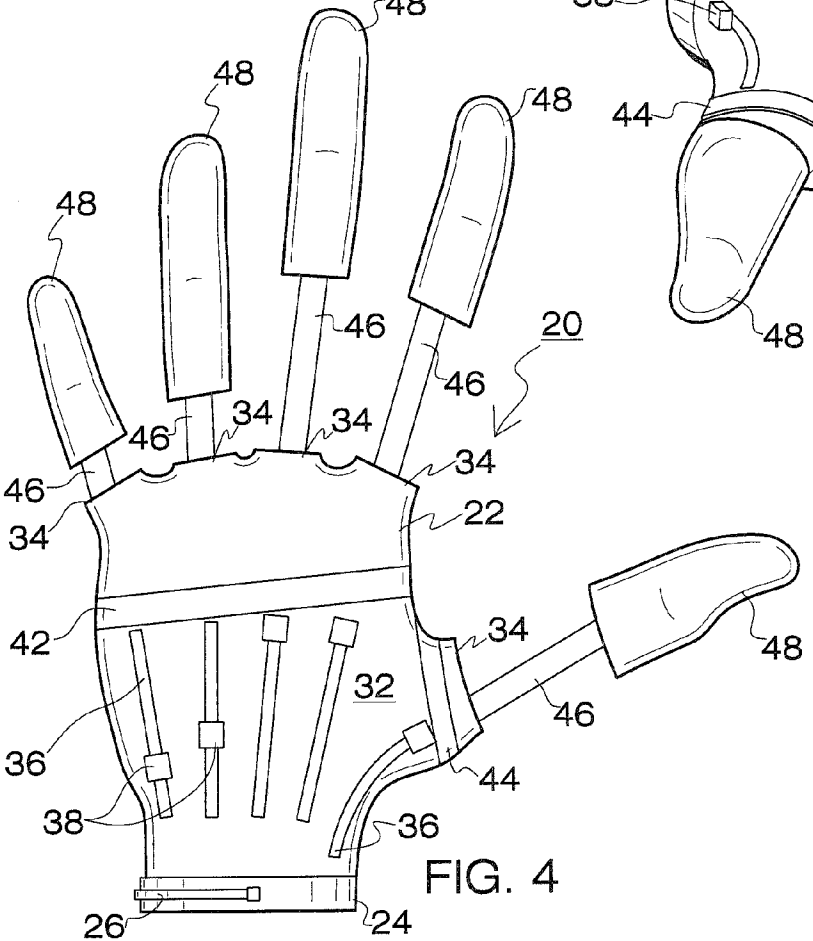
FIG. 4 is a top plan view of the glove showing the finger tip covers in the extended orientation.

As illustrated in FIGS. 4 and 7, four finger tip covers 48 are included for the user's pinky, ring, middle, index fingers and an additional cover 48 is included for the thumb. Each finger cover 48 is secured to the distal end of a finger band 46, whereby a respective finger tip cover 48 can be selectively secured and removed from the finger tip by manipulating the associated knob 38 and finger band 46. Namely, finger tip covers 48 are removed from a user's hand by pulling upwardly on the intermediate extent of the finger bands 46 to generate slack. This movement results in knobs 38 being moved to the distal end of the respective channel 36 (i.e. the end closest to the fingers). FIG. 6 illustrates glove 20 with knobs 38 in the distal position and slack within finger bands 46. Once this configuration is achieved, finger tip covers 48 can be easily removed to expose the finger tips of the user.

Knobs 38 are also used to in securing the finger tip covers. More specifically, with the finger tip covers in place on the fingers of the user, knobs 38 are used to remove any slack in finger bands 46. This is accomplished by sliding each of the knobs 38 downwardly to the proximal end of its respective channel 36 (i.e. the end furthest from the fingers). In this configuration, finer tip covers 48 are secured and the finger tips are covered and protected.

Glove 20 of the present invention also provides a means for storing the figure tip 48 covers when not in use. FIG. 8 illustrates finger tip covers 48 in the folded orientation. Namely, after the finger tip covers 48 have been removed (as described above), the associated finger bands 46 can be folded back to thereby place the finger tip covers 48 in facing relation to the panel portion 32 of glove 20. Finger tip covers 48 are retained in this folded configuration by way of the first and second bands (42, 44). That is, the pink, ring, middle, and index covers 48 are positioned beneath first band 42 and the thumb cover 48 is positioned beneath second band 44.

Glove 20 further includes a removable palm cover 52. Palm cover 52 is defined by both a proximal portion 54 (adjacent the base of the hand) and a distal portion 56 (adjacent the fingers). As illustrated, the proximal portion 54 includes a second track element 58 that is slidably connected to the first track 26 of wrist portion 24. In the preferred embodiment, second track element 58 is a female element formed from a hardened plastic. The female element is dimensioned to interface with the male element of first track 26 to permit the two to slide relative to one another. In an alternative embodiment, the first and second track (26, 58) interfit with one another in a zippered configuration.

Figure 10:
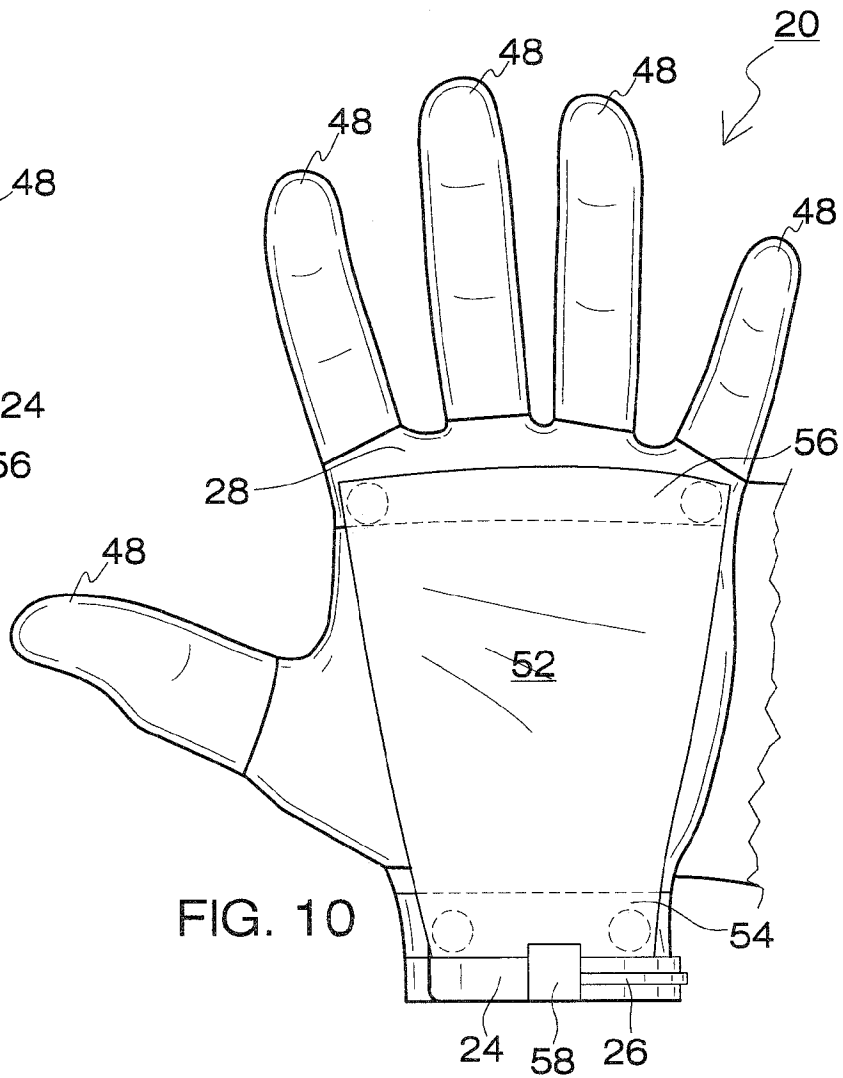
FIG. 10 is a bottom plan view of the glove with the fasteners securing the palm cover shown in phantom.
Figure 9:
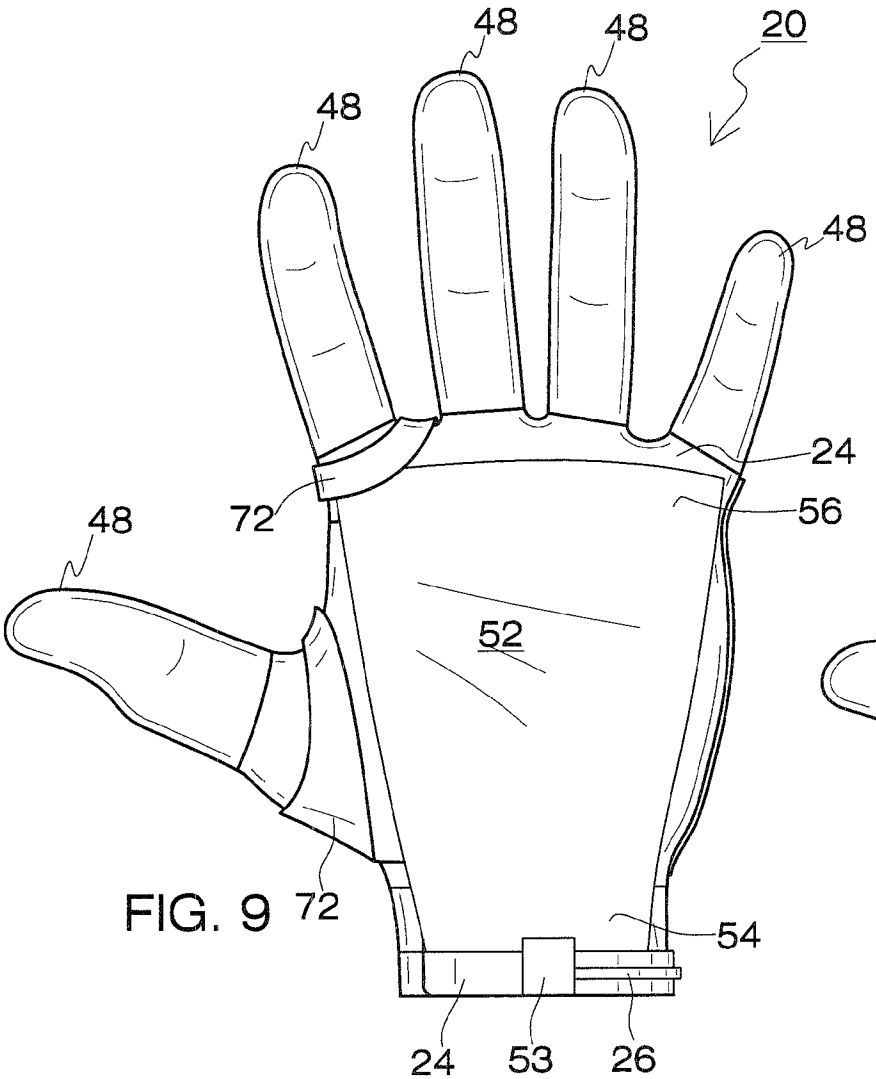
FIG. 9 is a bottom plan view of the glove showing the removable palm cover.
Figure 12:
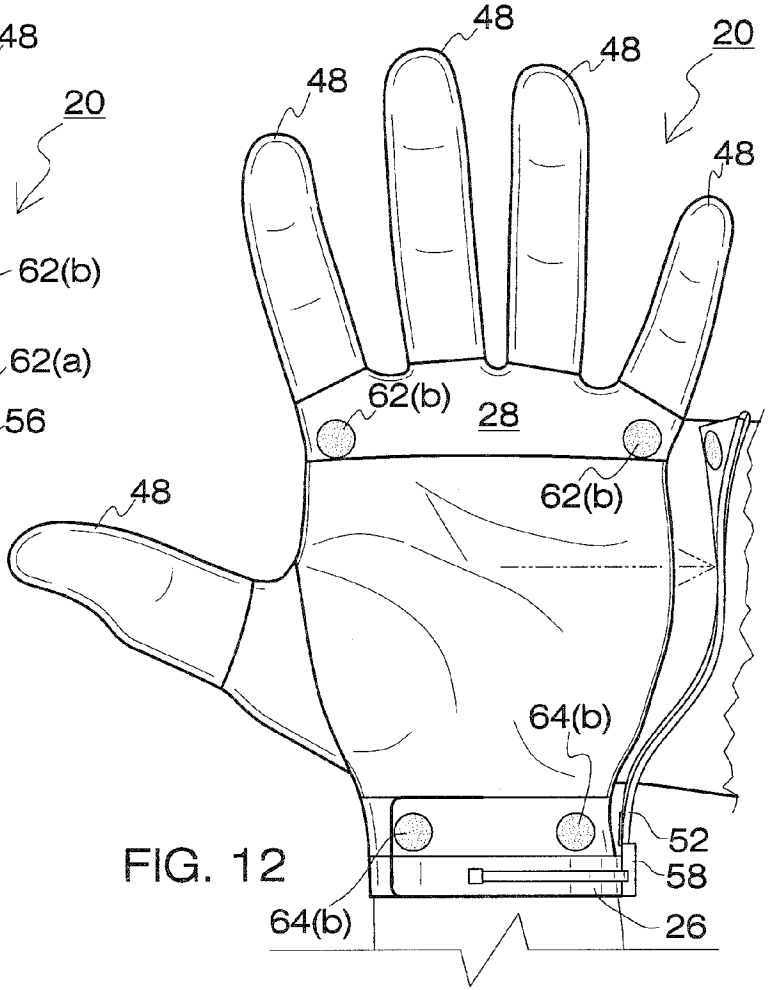
FIG. 12 is a bottom plan view of the glove and showing the palm cover sliding onto the dorsal side of the hand via the associated track.
Figure 11:
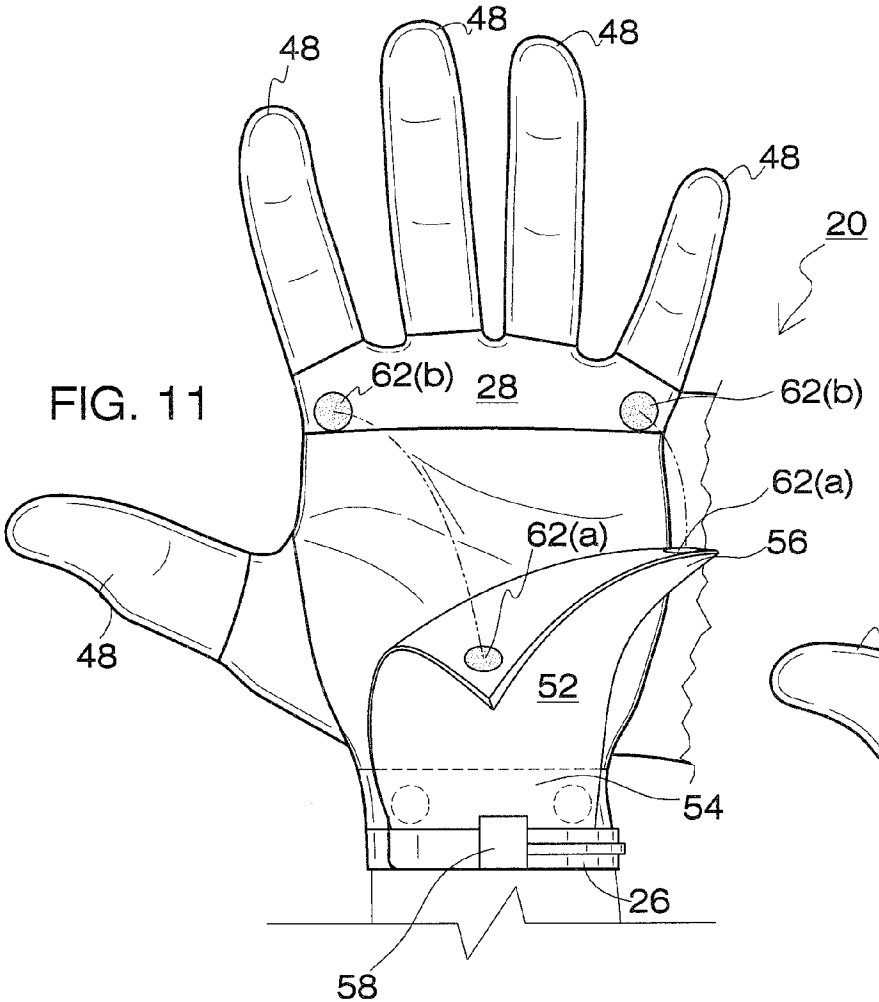
FIG. 11 is a bottom plan view of the glove and showing the palm cover being removed from the remainder of the glove.
Figure 14:
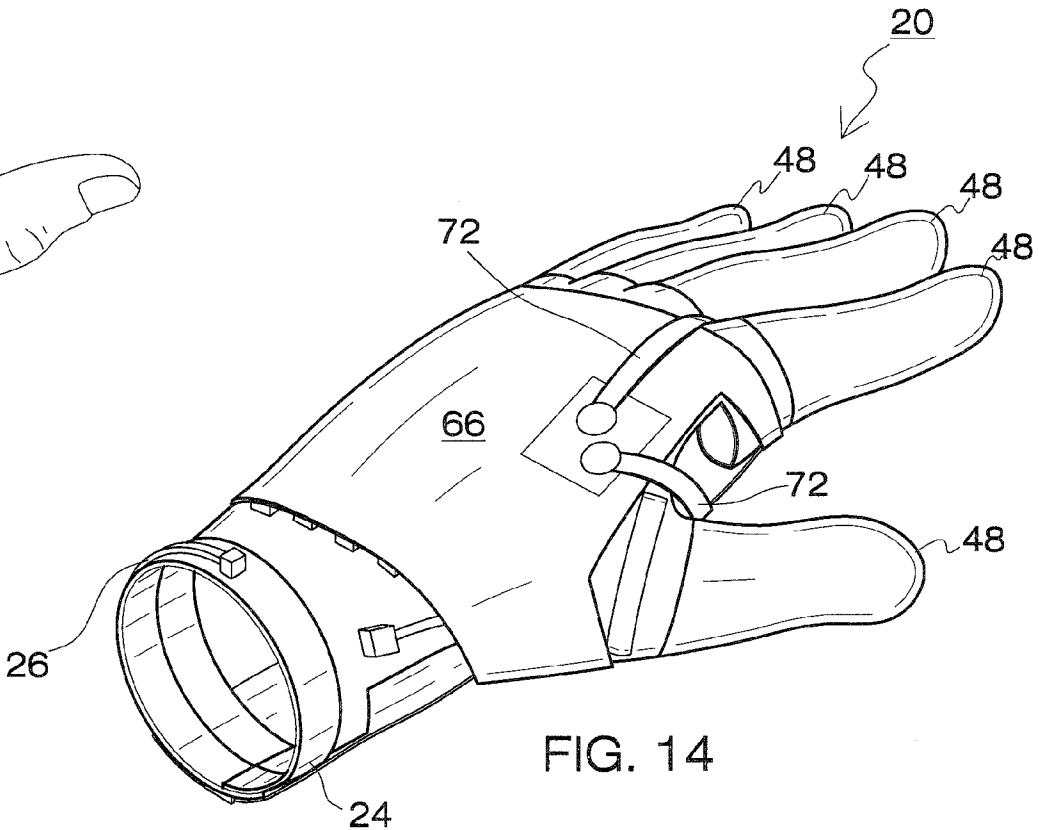
FIG. 14 is a perspective view of the glove showing the removable cover in place on the dorsal side of the hand.
Figure 13:
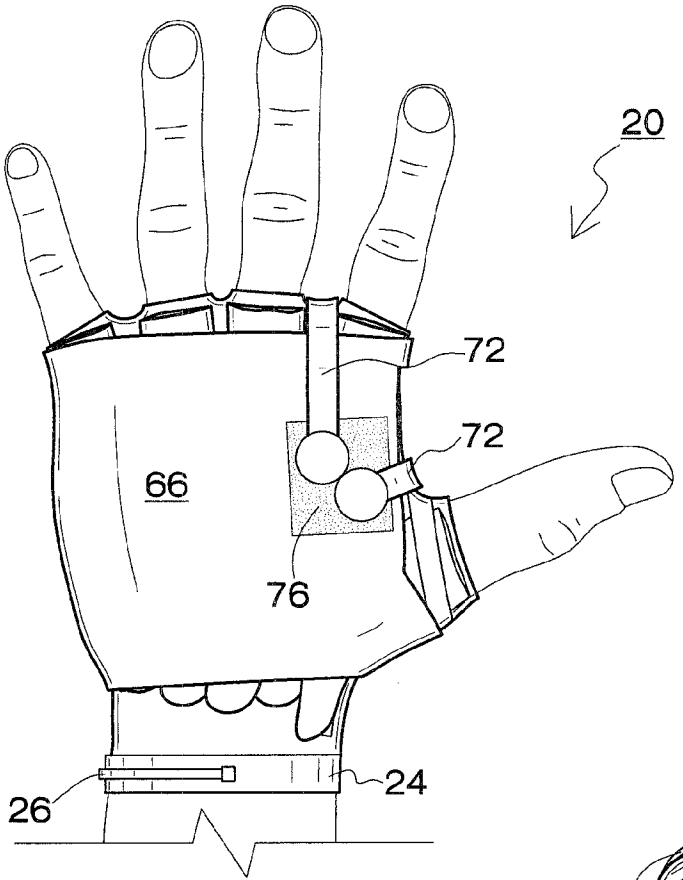
FIG. 13 is a top plan view of the glove with the finger tip covers in the folded orientation and with the removable cover in place on the dorsal side of the hand.

As illustrated in FIGS. 10-12, distal portion 56 of palm cover 52 is removably secured to the web portion 28 of glove body 22. In the preferred embodiment, this is achieved via a set of Velcro™ type fasteners. Namely, distal portion 56 of palm cover 52 includes two hook and pile fasteners 62(*a*) while web portion 28 includes two opposing hook and pile fasteners 62(*b*). This permits distal end 56 of palm cover 52 to be releasably secured to web portion 28. Additionally, proximal portion 54 of palm cover 52 includes two hook and pile fasteners 64(*a*) while the wrist portion 24 includes two opposing hook and file fasteners 64(*b*). These fasteners 64 thus permit proximal portion 54 of palm cover 52 to be releasbly secured to wrist portion 24. With all Velcro™ fasteners secured (62 and 64), as illustrated in FIG. 9, palm cover 52 overlies and protects the user's palm.

Figures 15, 16:
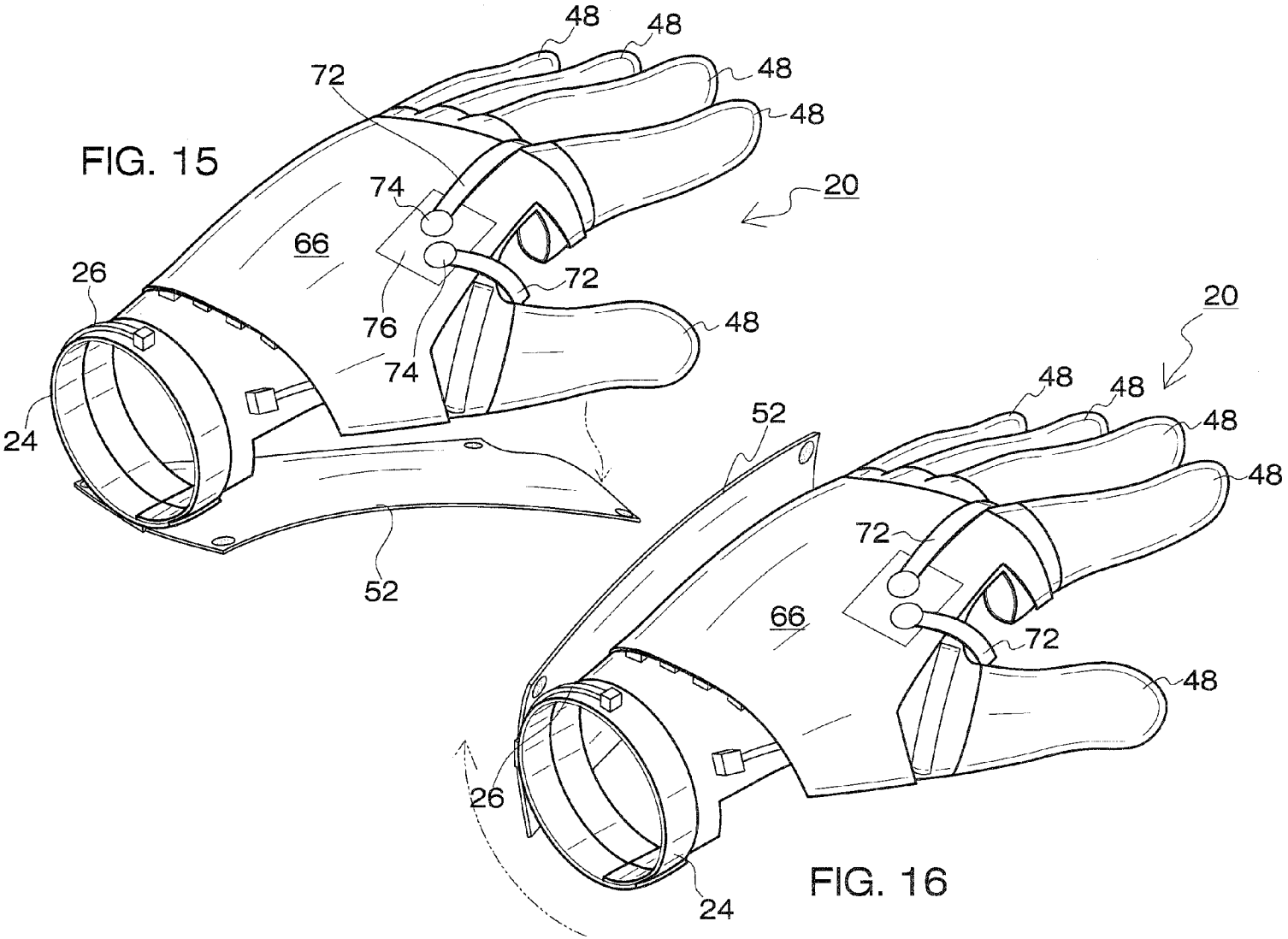
FIG. 15 is a perspective view showing the removable cover in place and the palm cover removed.
FIG. 16 is perspective view showing the removable cover in place and the palm cover being slid to the dorsal side of the hand.
Figure 17:
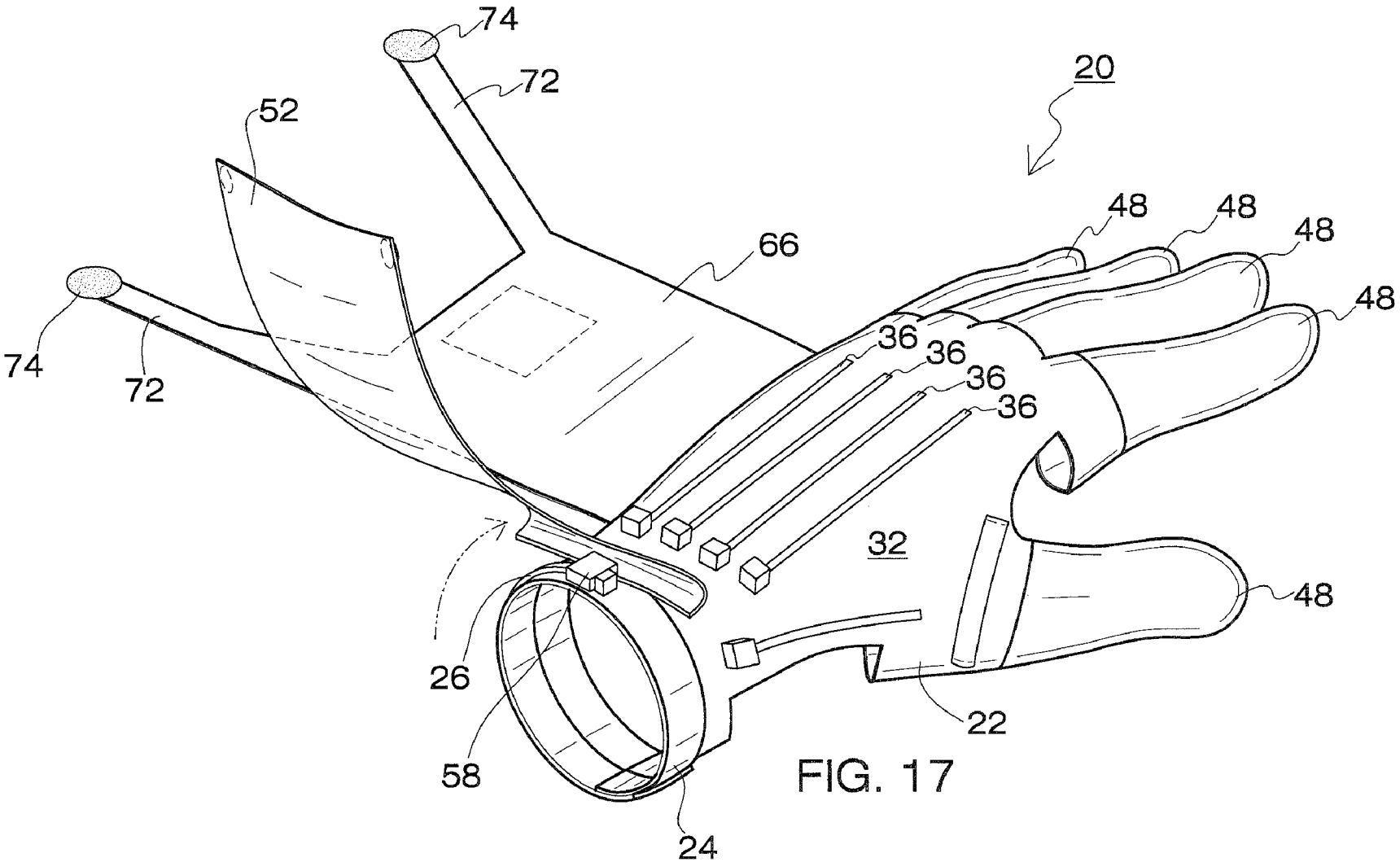
FIG. 17 is a perspective view of the glove showing the removable cover removed and the palm cover being positioned onto the dorsal side of the hand.
Figure 18:
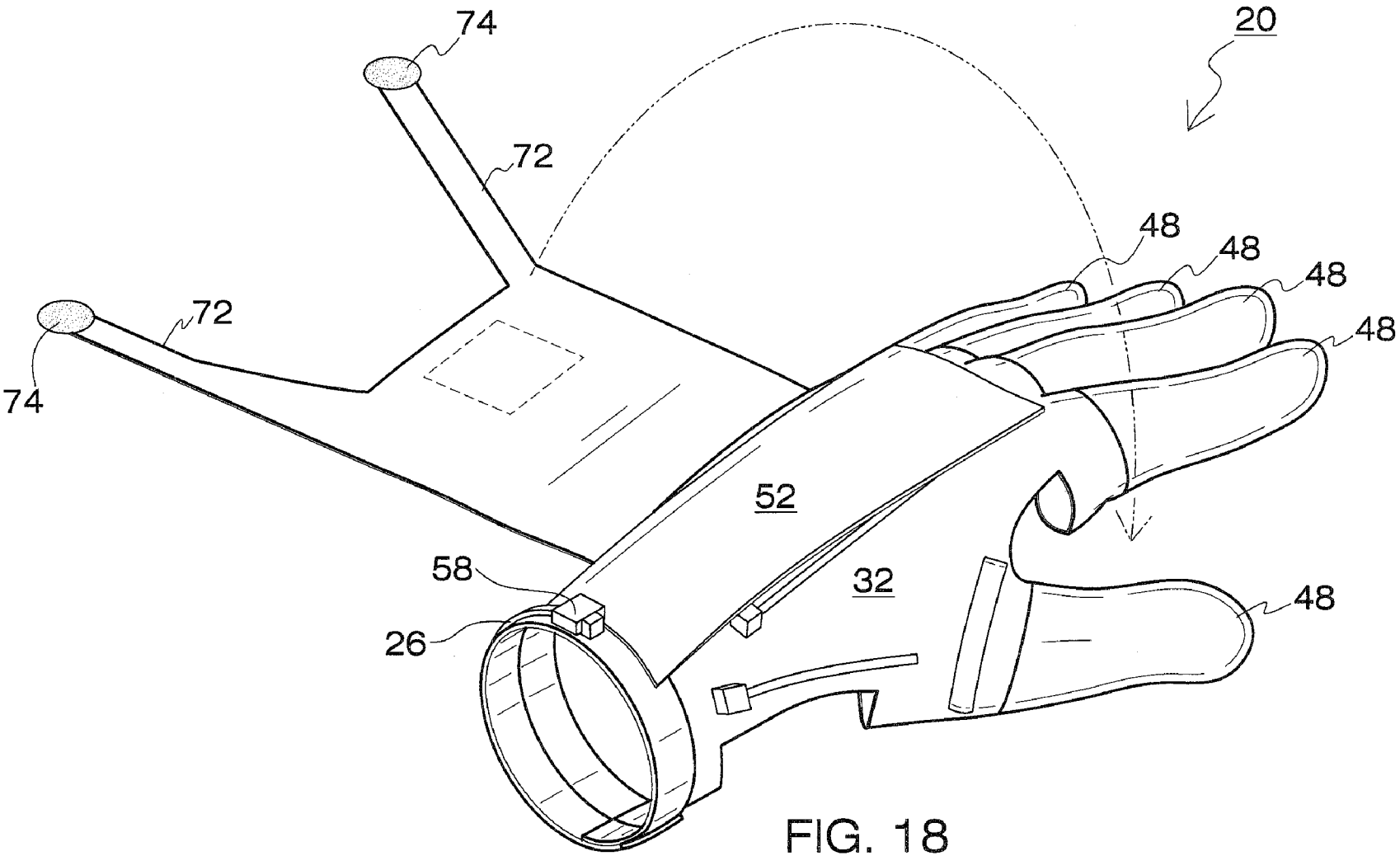
FIG. 18 is a perspective view of the glove showing the removable cover removed and the palm cover being positioned onto the dorsal side of the hand.
Figure 19:
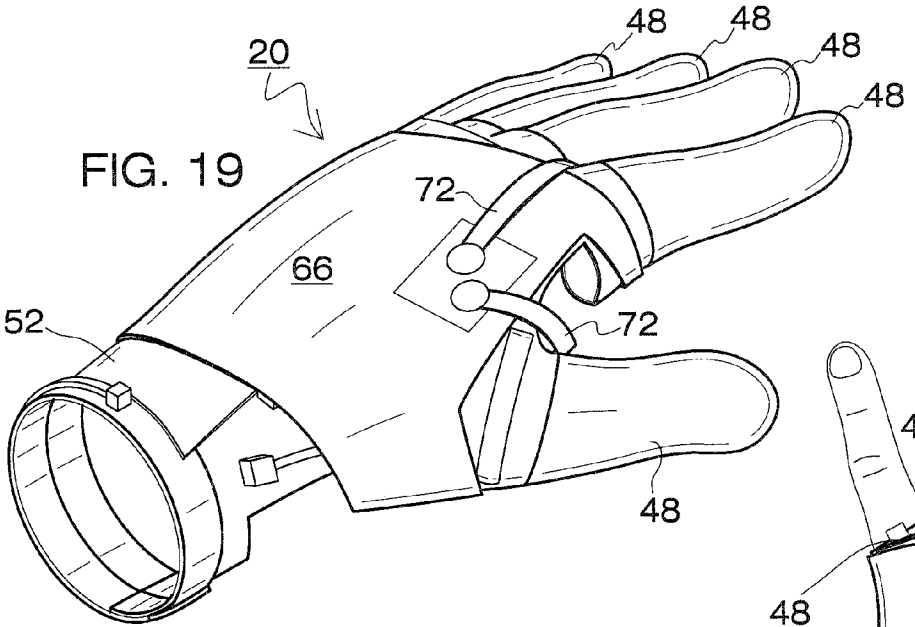
FIG. 19 is a perspective view of the glove with the removable cover and palm cover in position on the dorsal side of the hand.
Figure 20:
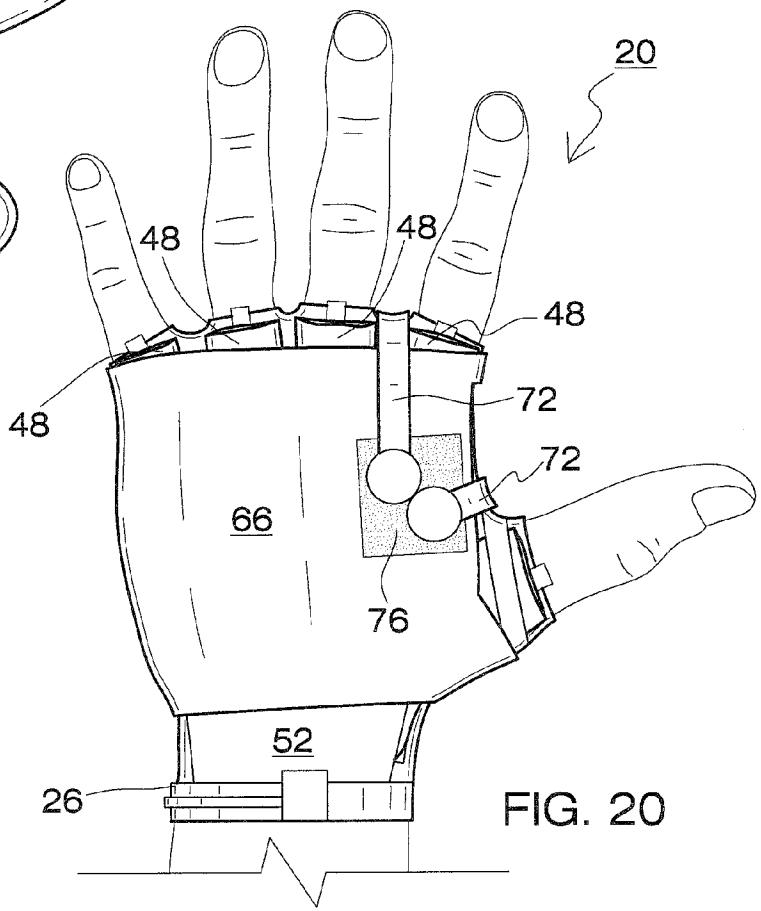
FIG. 20 is a perspective view of the glove with the removable cover and palm cover in position on the dorsal side of the hand.

Palm cover 52 is movable can be positioned on the dorsal side of the hand. This is accomplished by releasing all of the Velcro™ fasteners (62 and 64) and thereafter sliding palm cover 52 to the opposite side of the hand. As illustrated in FIGS. 15-17, the interfitting first and second tracks (26, 58) allow palm cover 52 to slide around wrist portion 24. The 180° length of first tract 26 allows palm cover 52 to move between facing positions between the palm and dorsal sides of the hand. However, it is within the scope of the present invention to provide a 360° track to thereby allow palm cover 52 to be moved entirely around the wrist of the user. Palm cover 52 can thereafter be secured to the panel portion 32 via additional Velcro™ fasteners.

In accordance with an additional embodiment of the present invention glove 20 can further include a removable exterior cover 66 for the dorsal side of glove 20. FIG. 2 illustrates exterior cover 66 in position upon the back of the user's hand. With reference to the sequence depicted in FIGS. 15-20, exterior cover 66 can be secured overtop of the palm cover 52 after palm cover 52 is secured to the dorsal side of the hand. In the preferred embodiment, exterior cover 66 includes a first side edge 68 that is secured to glove body 22 via a Velcro™ fastener strip. The opposite side of exterior cover 66 includes a pair of finger straps 72. The distal ends of finger straps 72 include Velcro™ type fasteners 74 that are adapted to be secured to an opposing Velcro™ type fastener 76 on the back of exterior cover 66. Thus, with exterior cover 66 in position, the first finger strap 72 is secured about the index finger while the second strap 72 is secured about the thumb. The ends of the finger straps 72 are then secured via the Velcro™ fasteners (74, 76). When in place, exterior cover 66 covers and protects channels 36, knobs 38 and palm cover 52. It further provides a convenient surface for indicia or advertising, as may be desired if the glove is used in competitive gaming. Finally, it is noted that the exterior cover 66 can be positioned with the finger tips covers 48 in either their deployed or folded orientation.

The entire glove 20 is preferably formed from a light weight, moisture absorbent material that provides excellent grip. The preferred material is a Polyester/Spandex blend. For instance, a material formed from 81% Polyester and 19% Elastane (or Spandex) would suffice. Other suitable materials include leather, synthetic leather, spandex, and blends thereof. Those of ordinary skill in the art will appreciate still yet other acceptable materials.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A convertible glove adapted to be worn by a user playing a video game, the user having a hand with a dorsal side, a palm with an upper portion, a wrist, fingers with a lower extent and finger tips, the glove covering the wrist, the dorsal side of the hand, the upper portion of the palm, the glove also selectively covering the palm and finger tips while leaving the lower extent of the fingers exposed, the glove comprising:

a glove body having a wrist portion encircling the wrist, a web portion covering the upper portion of the palm, and a panel portion covering the dorsal side of the hand, the glove body further including a series of finger openings, a channel with a slidable knob associated with each of the finger openings and formed within the panel portion, a retaining band positioned upon the panel portion adjacent the finger openings, a first track positioned along the wrist portion;

a series of finger bands, each band associated with a corresponding finger opening and having proximal and distal ends, the proximal end of each band secured to a knob;

a series of finger tip covers, each cover secured to the distal end of a finger band, whereby a respective finger tip cover can be selectively secured and removed from the finger tip by manipulating the associated knob and finger band, the finger tip covers having a folded configuration, wherein the finger tip covers are folded back upon the panel portion and secured by the retaining band;

a palm cover having proximal and distal portions, the proximal portion having a second track that is slidably connected to the first track, the distal portion of the palm cover being removably secured to the web portion, whereby when the distal portion is unsecured from the web portion the palm cover can be slid about the wrist and thereafter secured to the dorsal panel.

2. A convertible glove comprising:

a glove body having a wrist portion encircling a wrist of a user, a web portion covering an upper portion of a palm of a hand of the user, and a panel portion covering a dorsal side of the hand of the user, the glove covering the wrist, the dorsal side of the hand, and the upper portion of the palm, the glove also selectively covering a finger tip area and the palm of the hand while leaving a lower extent of the users fingers exposed, wherein, the glove body further includes a series of finger openings, a channel with a slidable knob associated with each of the finger openings and formed within the panel portion;

a series of finger bands, each band associated with a corresponding finger opening and having proximal and distal ends, the proximal end of each band secured to a knob;

a series of finger tip covers, each cover secured to the distal end of a finger band, whereby a respective finger tip cover can be selectively secured and removed from the finger tip by manipulating the associated knob and finger band a retaining band secured to the panel portion and wherein the finger tip covers have a folded configuration, wherein the finger tip covers are folded back upon the panel portion and secured by the retaining band.

3. The glove as described in claim 2 further comprising a first track positioned along the wrist portion of the glove body and a palm cover having proximal and distal portions, the proximal portion having a second track that is slidably connected to the first track, the distal portion of the palm cover being removably secured to the web portion, whereby when the distal portion is unsecured from the web portion the palm cover can be slid about the periphery of the wrist and thereafter secured to the dorsal panel.

4. The glove as described in claim 2 further comprising an exterior cover adapted to be removably secured over top of the panel portion, channels and knobs.

* * * * *